US009648990B1

(12) United States Patent
Corney

(10) Patent No.: US 9,648,990 B1
(45) Date of Patent: May 16, 2017

(54) VENTING SYSTEM FOR DISPENSER RESERVOIR

(71) Applicant: GOJO Industries, Inc, Akron, OH (US)

(72) Inventor: Richard E. Corney, Akron, OH (US)

(73) Assignee: GOJO Industries, Inc, Akron, OH (US)

( * ) Notice: Subject to any disclaimer, the term of this patent is extended or adjusted under 35 U.S.C. 154(b) by 0 days.

(21) Appl. No.: 14/636,752

(22) Filed: Mar. 3, 2015

Related U.S. Application Data

(60) Provisional application No. 61/949,614, filed on Mar. 7, 2014.

(51) Int. Cl.
*B65D 88/54* (2006.01)
*A47K 5/12* (2006.01)
*B65D 53/02* (2006.01)

(52) U.S. Cl.
CPC ..... *A47K 5/1211* (2013.01); *B65D 53/02* (2013.01)

(58) Field of Classification Search
CPC ..... A47K 5/1211; A47K 5/122; A47K 5/00–5/13; B65D 53/02
See application file for complete search history.

(56) References Cited

U.S. PATENT DOCUMENTS 3,540,402 A * 11/1970 Kocher ..... H01M 2/362 137/454
4,964,544 A * 10/1990 Hanna ..... A47K 5/1207 137/859
5,472,122 A * 12/1995 Appleby ..... B65D 47/2031 222/212
6,142,750 A * 11/2000 Benecke ..... A47L 13/20 222/383.2
6,378,742 B1 * 4/2002 Rohr ..... B67D 1/0835 222/482
2003/0141318 A1 * 7/2003 Sorensen ..... A47K 5/122 222/214
2014/0263464 A1 * 9/2014 Corney ..... A47K 5/1204 222/207

* cited by examiner

*Primary Examiner* — Frederick C Nicolas
*Assistant Examiner* — Bob Zadeh
(74) *Attorney, Agent, or Firm* — Calfee, Halter & Griswold LLP

(57) ABSTRACT

A fluid product reservoir, for a dispensing system, is made of a walled container having an aperture formed at one end thereof. A reservoir cap seals the aperture from exposure to the atmosphere. A pump integrated into the reservoir cap allows fluid product to be dispensed from a dispensing system. A venting mechanism is installed at the interface between the aperture and the reservoir cap to allow air from the atmosphere to displace fluid product as it is being dispensed. The venting mechanism includes a one-way valve, which permits air to flow into the reservoir but prevents fluid product from leaking out from the interface between the aperture in the reservoir cap.

15 Claims, 8 Drawing Sheets

VENTING SYSTEM FOR DISPENSER RESERVOIR

RELATED APPLICATIONS

This patent application claims priority to provisional patent application Ser. No. 61/949,614, titled VENTING SYSTEM FOR DISPENSER RESERVOIR, filed on Mar. 7, 2014 which is incorporated herein by reference in its entirety.

FIELD OF THE INVENTION

The current invention relates generally to fluid product dispensers and in particular to dispenser reservoirs. More specifically, the invention relates to ways of venting the reservoir during the dispensing process without leaking liquid product.

BACKGROUND OF THE INVENTION

It is known to dispense hand care products from a dispenser mounted to a wall, counter or dispenser stand. Dispensers may be conveniently located in building entrances, bathrooms, or lunchrooms providing convenient accessibility to passersby. Such dispensers may have a replaceable reservoir, also called a refill unit, containing hand soap, lotion or sanitizer. Replaceable reservoirs provide a sanitary solution to the problem found in refillable dispensers, which is that over time germ-laden bio-films form inside the fluid container and dispenser nozzle.

Replaceable reservoirs are often installed into dispensers in an inverted manner, which takes advantage of gravity to draw fluid out of the container. The reservoirs are connected to a pump, which pressurizes the fluid and meters out a predetermined amount of product. In many systems, the reservoirs are sealed from exposure to the atmosphere. As such, air cannot displace the fluid being pumped out of the reservoir thereby creating a vacuum inside the container. This makes it harder for the pump to draw fluid out of the reservoir. In systems using an onboard power supply, like batteries, additional energy is needed to operate the pump thus shortening the useful life of the batteries.

To overcome this problem, some reservoirs are constructed using thin gauge material. Thin-walled reservoirs are prone to collapse under atmospheric pressure as fluid is removed from the container. While the problem associated with vacuum pressure is somewhat alleviated, the thin gauge walls are susceptible to damage. Moreover, it is hard to read how much fluid is remaining in the refill reservoir because thin walls collapse unevenly and unpredictably. It would be advantageous to use a rigid bottle with heavier gauge material if only there was a way to vent the inverted bottle without spilling its contents. The embodiments of the current invention overcome the aforementioned problems.

SUMMARY OF THE INVENTION

In one embodiment of the subject invention, a dispensing system is provided that uses a replaceable reservoir for storing fluid product. The replaceable reservoir, also termed refill unit, comes assembled with a pump and nozzle. A cap secures the pump and nozzle to an aperture formed in the reservoir. Screw threads interconnect to lock the cap in place in a fluid tight manner. The cap includes one way venting gasket that extends around an interior peripheral region of the cap and surrounds the aperture formed in the replaceable reservoir. The one-way venting gasket allows air to flow into the reservoir through cap only when fluid product is dispensed from the reservoir.

In one particular embodiment of the dispensing system, the one way venting gasket includes a first gasket portion having one or more air passageways fashioned therein and a second flexible gasket portion that seals the one or more air passageways in the first gasket portion.

In another embodiment, the one way venting gasket comprises a check valve that lets air in through the gasket and prevents fluid in the reservoir from leaking out of the reservoir.

In another embodiment of the subject invention, a refill unit for an associated dispenser dispensing associated liquid product comprises: a container defining a volumetric region for storing associated liquid product, wherein the container includes an opening defining a rim; a container lid covering the opening wherein a surface of the container lid is juxtaposed to the rim, wherein the container lid includes an aperture through which associated liquid product is allowed to be dispensed from the container; a first gasket member in sealing engagement with either the rim and/or the surface of the container lid, wherein the first gasket member includes a hole extending therethrough to allow ambient air to flow into the container when associated liquid product is dispensed from the container; and, a second gasket member juxtaposed to the first gasket member in a sealed liquid tight relationship, wherein the second gasket member is in sealing engagement with either the rim and/or the surface of the container lid, wherein the second gasket member is configured to cover the hole in the first gasket member to prevent associated liquid product from passing through the hole in the first gasket member, and wherein the second gasket member is deflected from covering the hole when associate liquid product is dispensed from the container.

In one aspect of the subject invention, the first gasket member in sealing engagement with the rim of the container and the second gasket member is in sealing engagement with the container lid.

In another aspect of the subject invention, the first gasket member is fixedly attached to the second gasket member.

In yet another aspect of the subject invention, the second gasket member includes a base, also called base portion, that seals against either the rim or the surface of the container lid, and a flap integrally form with the base, where the flap extends generally orthogonally from the base to cover the hole in the first gasket member. The flap may also extend from the base, i.e. with respect to the base, at an acute angle.

In still another aspect of the subject invention, the material comprising the flap has memory (i.e. it tends to return to its originally formed configuration after being deflected or deformed), wherein the flap is biased in a first position to cover the hole in the first gasket member. The flap is also deflectable from the first position to a second position to expose the hole in the first gasket member as occurs when the pump is actuated to dispense associated liquid product thereby creating a negative vacuum pressure within the container.

In even another aspect of the first gasket member has an annular configuration defining an inner circumference and an outer circumference, and the hole extends from the outer circumference to the inner circumference. The second gasket member may also have an annular configuration.

In still yet another aspect of the subject invention, the first gasket member includes a plurality of holes spaced around the inner circumference of the first gasket member, which may be equidistantly spaced around the inner circumference of the first gasket member.

In another aspect of the subject invention, a selectively actuatable pump is operatively fluidly connected to the aperture in the container lid to dispense associated liquid product from the refill unit.

In another embodiment of the subject invention, a refill unit for an associated dispenser dispensing associated liquid product, includes a container defining a volumetric region for storing associated liquid product, wherein the container includes an opening defining a rim, and wherein the container includes a first fastening member; a container lid covering the opening wherein a surface of the container lid is juxtaposed to the rim, and wherein the container lid includes a second fastening member operatively attached to the first fastening member for affixing the container lid to the container; a pump operatively connected to dispense associated liquid product from the container; a gasket disposed between the rim and the surface of the container lid to seal the rim and the container lid in a liquid tight manner, wherein the gasket is generally annular thereby defining an inner circumference and an outer circumference, and wherein the gasket includes a hole extending from the outer circumference to the inner circumference; and a flap extending from the gasket to selectively cover the hole in the gasket, wherein associated liquid product is prevented from passing through the hole and out of the container, and wherein ambient air is allowed to pass through the hole and into the container when the pump is operated to dispense associate liquid product.

In one aspect of the subject invention, the flap is integrally formed with the gasket.

In another aspect of the subject invention, the flap is generally pliable, or elastically deformable, and is constructed from material having memory, and wherein the flap is biased in a first position to cover the hole, and wherein the flap is deflectable from the first position to a second position to expose the hole when the pump is operated to dispense associated liquid product.

In yet another aspect of the subject invention, the gasket includes a plurality of holes spaced around the inner circumference of the gasket; and the flap has an annular configuration adapted to cover the plurality of holes in the gasket.

In another embodiment of the subject invention, a gasket for an associated container storing associated liquid product wherein the container includes an opening defining a rim, and an associated container lid covering the opening wherein a surface of the associated container lid is juxtaposed to the rim, comprises: a generally planar gasket having first and second sides separated by a body portion, wherein the gasket is generally annular thereby defining an inner circumference and an outer circumference, and wherein the body portion includes a plurality of spaced apart holes extending from the outer circumference to the inner circumference; and a flap generally extending from one of the first and second sides of the gasket to the inner circumference of the gasket, wherein the flap is constructed from material having memory, and wherein the flap is biased in a first position to cover the holes on the inner circumference of the gasket thereby preventing the passage of liquid or air from the inner circumference to the outer circumference, and wherein the flap is deflectable to a second position exposing the holes on the inner circumference of the gasket when liquid or air passes through the hole in the direction from the outer circumference to the inner circumference.

In one aspect of the subject invention, the gasket is constructed from elastomeric material.

In another aspect of the subject invention, the gasket and the flap are integrally fashioned as a singular unit, but can be separable components.

BRIEF DESCRIPTION OF THE DRAWINGS

FIG. 4*b* is a close-up, cross sectional view of another alternate embodiment of the reservoir cap showing the venting mechanism of the replaceable reservoir, according to the embodiments of the subject invention.

DETAILED DESCRIPTION

Figure 1:
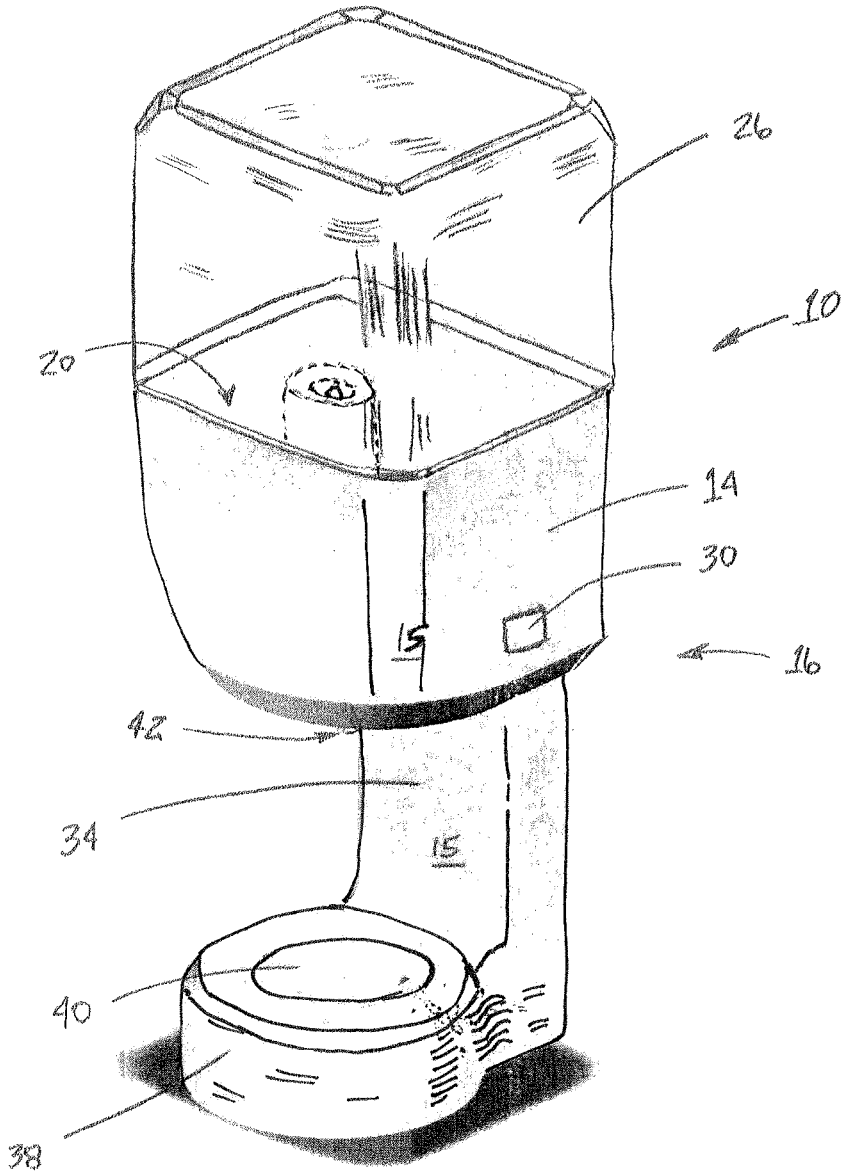
FIG. 1 depicts an exemplary fluid dispensing system according to the embodiments of the subject invention.

A product dispensing system is depicted in FIG. 1 that dispenses a measured amount of liquid product according to the embodiments of the subject invention. In one exemplary instance, the dispensing system, shown generally at 10, dispenses hand care products like soap, lotion or sanitizers, although other products may similarly be dispensed from the product dispenser.

In the embodiment depicted in FIG. 1, the dispensing system 10 includes a base 14. The base 14 is made of one or more walls 15 constructed to support the components of the dispensing system 10. Plastic may be used for cost effective manufacturing of the base 14, as well as other components of the system. A fluid reservoir 26, also termed herein as container 26, is mounted to the base in an inverted fashion and includes a pump for dispensing product in a manner known in the art. At a rear side 16 of the base 14, a mounting bracket is included for attaching the dispenser to a table, IV pole (Intravenous pole), dispenser stand or other supporting structure, none of which are shown in the figures. The mounting bracket may be modular in design, which is to say that the mounting bracket may be detached from the base 14 and replaced with another type of mounting bracket. In this way, different types of mounting brackets may be used for attaching the dispensing system to different types of supporting structures.

As mentioned, the base 14 is designed to securely receive the fluid reservoir 26. The walls 15 of the base 14 are constructed to form a concave region 20 at an upper end of the dispensing system 10. Structural components, not shown, receive and lock the reservoir 26 in place during use. A latch 30 is included for releasing the fluid reservoir when service is required.

Figure 2:
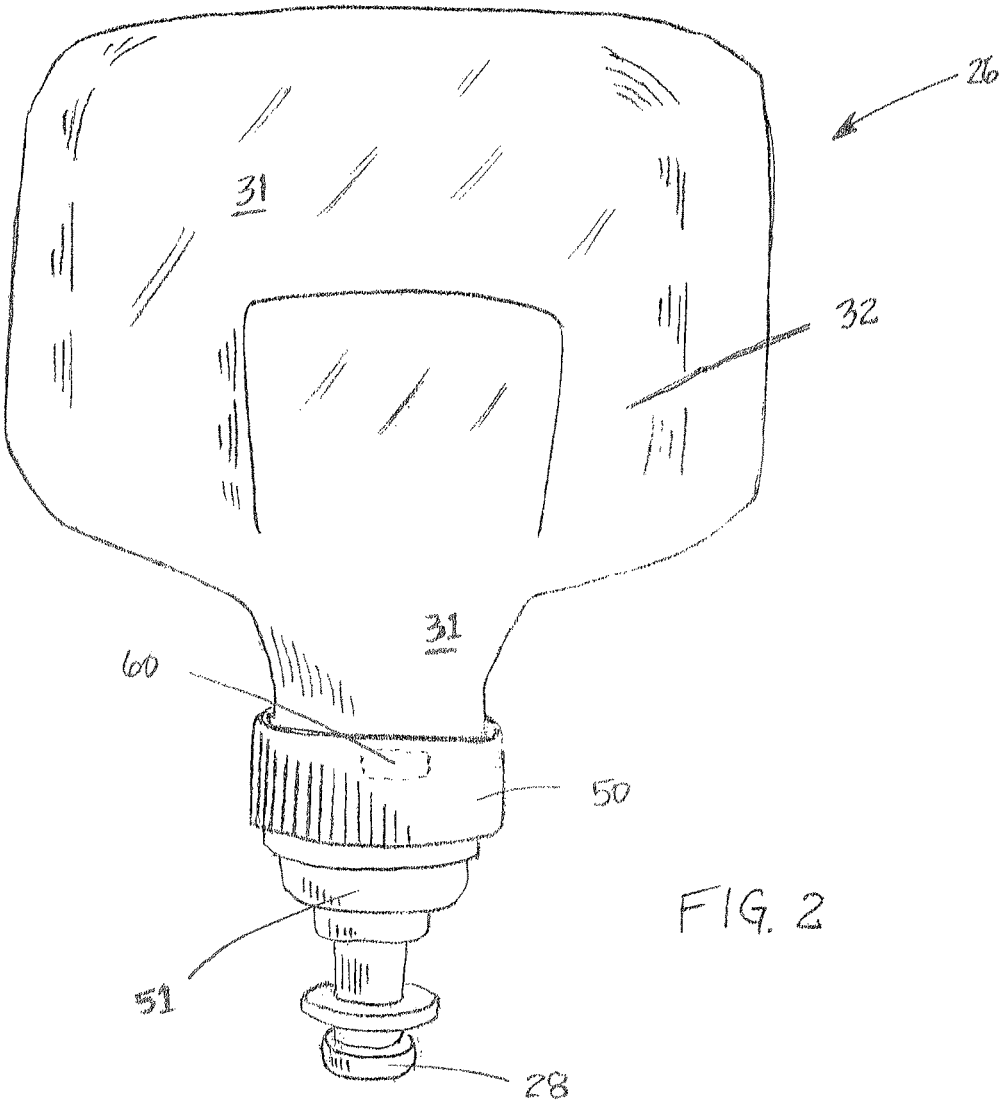
FIG. 2 depicts a replaceable reservoir of the dispensing system shown in FIG. 1, according to the embodiments of the subject invention.

Before installation into the base 14, the reservoir is fitted with a pump 51 (shown in FIG. 2). The pump is engaged by an assembly of linkages and driven by a motor, not shown, for actuating the pump and dispensing the product. Batteries may be stored onboard the dispensing system 10 to provide power for actuating the pump. For dispersing fluid product in the desired manner, a nozzle 28 is attached to an outlet of the pump.

With continued reference to FIG. 1, the base 14 may include a spine 34 or back plate 34 extending downwardly from the base 14. In one embodiment, the spine 34 is integrally fashioned with the base 14. However, other embodiments are contemplated where the spine 34 may be fastened to the base 14. A drip plate 38 extends from the distal end of the spine 34 and protrudes outward at an angle of approximately 90 degrees, although any acute angle may be chosen with sound judgment. The drip plate 38 is thus positioned at an elevation beneath the pump, and more specifically beneath the nozzle. Persons of skill in the art will understand that the drip plate 38 will capture residual product that may drip from the nozzle during or after use. Accordingly, the drip plate 38 may be constructed with a concave center 40 to catch fluid product until it evaporates or is cleaned by service personnel.

In one embodiment, the batteries (not shown) may be housed in the body of the drip plate 38. Conductors (also not shown) may be routed from the battery cavity up to the motor located in the base 14. It follows that the conductors run to the motor through the spine 34. In other embodiments, electronic circuitry, e.g. circuit boards, used by the dispensing system 10 may also be housed in the base 14 or spine 34. It is expressly noted here that other configurations of the dispenser housing may be employed that do not include a spine 34 or drip plate 38. In these embodiments, the control circuitry as well as the batteries may be housed in the base 14. All such variations are to be construed as falling within the scope of coverage of the embodiments of the subject invention.

Still referencing FIG. 1, the product dispensing system 10 may be activated without touching the base 14 or any component of the system. Accordingly, the "touch-free" system may include one or more sensors 42 that detect motion beneath the nozzle. In one exemplary embodiment, the sensors 42 use IR (infrared) technology, which may be installed on an underside of the base 14. To avoid accidental activation, the sensor's field of detection may be oriented, i.e. angled, to detect motion only within a region between the base 14 and the drip plate 38. Other types of sensors and/or configurations of sensors may be chosen without departing from the intended scope of coverage of the embodiments of the subject invention.

Other embodiments are considered where the dispensing system 10 is manually activated. A push-bar or lever (not shown in the figures), may be moveably connected to the base 14 of the dispensing system 10. In one particular embodiment, the push-bar may pivot to directly contact the actuating components of the pump 51. Alternatively, the push-bar may engage a linkage (or linkages) to actuate the pump 51. In operation, the user physically depresses the push-bar. Force from the user's hand is translated to actuate the pump 51. In any case, the need for a motor or other electrically powered actuator is eliminated, as well as the need for motion sensors.

With reference now to FIG. 2, the fluid reservoir 26, or container 26, comprised of a plurality of walls 31, is generally enclosed for storing a predetermined quantity of fluid product, and more specifically liquid product, in a reservoir area 32. An aperture or opening is included through which fluid enters or exits the reservoir 26. The aperture may be constructed having externally fashioned threads 46 (i.e., a first fastening member), shown in FIG. 4, designed to receive and hold a cap 50 in place once assembled. It follows that the cap 50, also known as a container lid 50, includes matching threads 52 (i.e., a second fastening member) that interconnect with threads 46 in a manner well known in the art. In one particular embodiment, the reservoir 26 may be constructed via a blow-molding process, although other thermoforming processes may be used as chosen with sound engineering judgment. The reservoir 26, which may be a replaceable refill unit or reservoir, can be constructed from rigid or semi-rigid polymeric material, as discussed below. Accordingly, as liquid product flows out of the reservoir 26, the walls 31 of the container may substantially maintain its original shape. Notably, other means of attaching the container lid to the container may be chosen with sound judgment.

Figure 3:
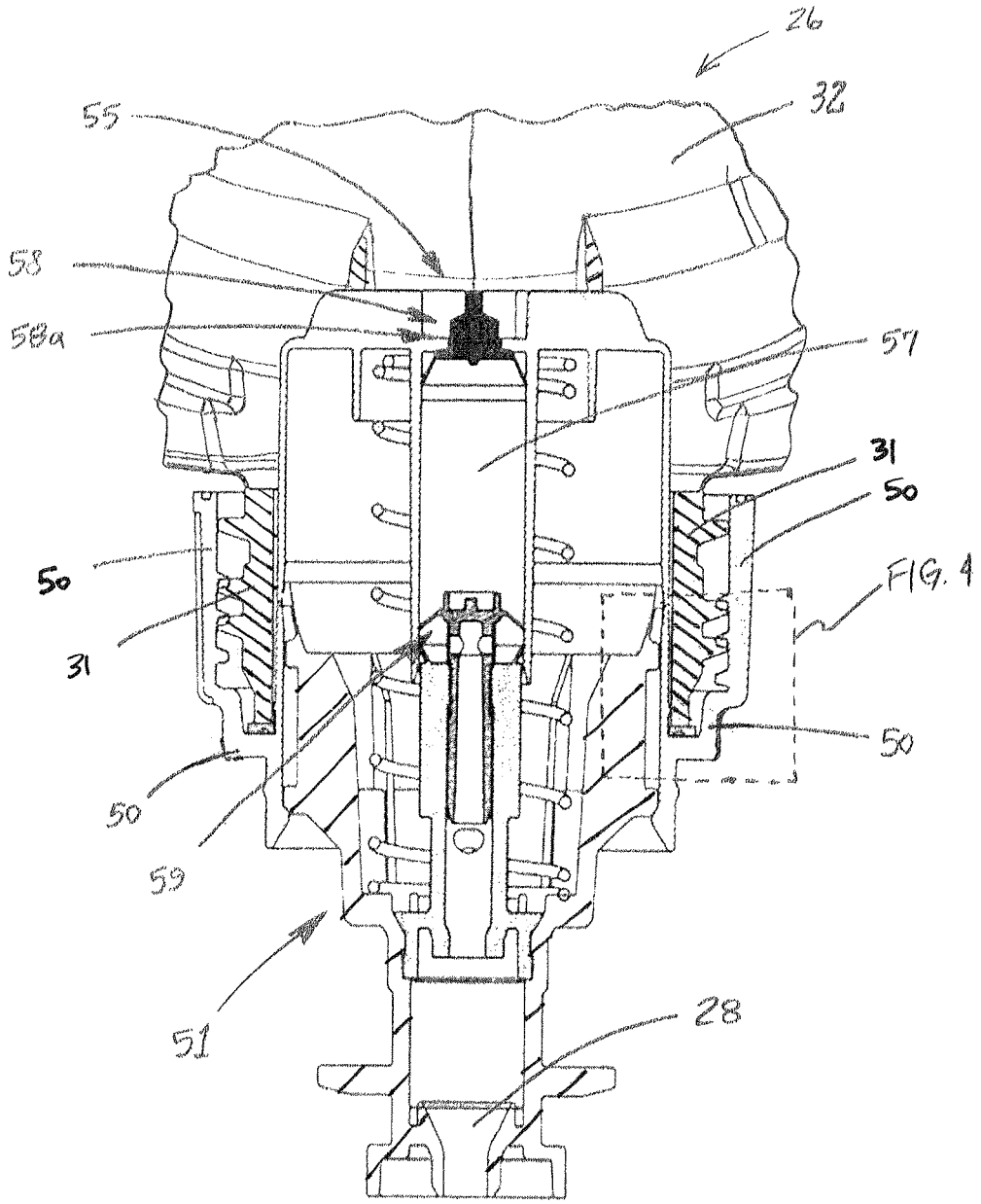
FIG. 3 is a cross sectional view of the pump and reservoir cap of the dispensing system shown in FIGS. 1 and 2, according to the embodiments of the subject invention.

With continued reference to FIG. 2 and now also to FIG. 3, the pump 51, as introduced above, fluidly connects to the aperture of the fluid reservoir 26. By fluidly connects it is meant that the inlet 55 of the pump 51 is positioned to receive fluid product stored in the reservoir area 32. As such, the pump 51 is juxtaposed to or extends into the fluid reservoir 26 and may be secured in place by the cap 50. In one particular embodiment, the pump 51 comprises a pump chamber 57. At one end of the pump chamber 57, a valve 58 is positioned to allow fluid flow in only one direction, namely from the reservoir area 32 into the pump chamber 57. The valve 58 may comprise a spring-biased, check valve **58*a*. At the distal end of the pump chamber 57, another valve 59 is included that similarly connects to the nozzle 28 and also only allows fluid flow in one direction. A piston reciprocates within the pump chamber 57 in first and second directions. The piston is sealed within the pump chamber 57 so that fluid product enters and exits only through the valves 58, 59. Skilled artisans will understand that when the piston is moved in a first direction, fluid is drawn into the pump chamber 57 from the reservoir area 32 because of negative vacuum pressure created by displacement of the piston. Conversely, movement of the piston in the second direction will force fluid out of the chamber 57 and through the nozzle 28. Accordingly, fluid is prevented from flowing back into the reservoir area 32. In that the construction and operation of the dispenser pump 51** is known in the art, no further explanation will be offered at this time.

It is expressly noted here that the pump 51 may be integrally fashioned with the cap 50. However, alternative embodiments are contemplated where the pump 51 comprises a separate component that installs with the cap 50 onto the fluid reservoir 26. In either case, once securely installed, a fluid tight connection is made between the aperture of the fluid reservoir 26 and the pump/cap assembly.

With continued reference to FIG. 2, a validation key 60 or tag may be implemented between fluid reservoir 26 and dispensing system 10 for validating the contents of the fluid reservoir 26. In one particular embodiment, the cap 50 includes the validation key 60. The key 60 may comprise an RFID (Radio Frequency Identification) tag, which may be either passive or active. A corresponding interrogator, not shown, may be mounted within the base 14. Accordingly, when the fluid reservoir 26 is installed onto the base 14, the interrogator will automatically "ping" the electronic key 60 to verify that the correct fluid reservoir 26 is being used. If an incorrect fluid reservoir is installed, a control system will disable operation of the dispenser 10. Alternative types of validation keys are contemplated where in the cap 50 includes an electrically conductive coil, not shown in the figures. The coil may be constructed having a predetermined impedance. When the fluid reservoir 26 is installed onto the base 14, the coil is communicated with the controller which may sense or measure the impedance for use in validating the fluid reservoir 26. Skilled artisans will appreciate that other locations for and other forms of validating keys 60 may be used, like for example keyed mechanical fittings or optical sensor systems. Still, any manner of ensuring that the dispensing system 10 works only with an authorized fluid reservoir 26 may be chosen as is consistent with the subject invention described herein.

Figure 4:
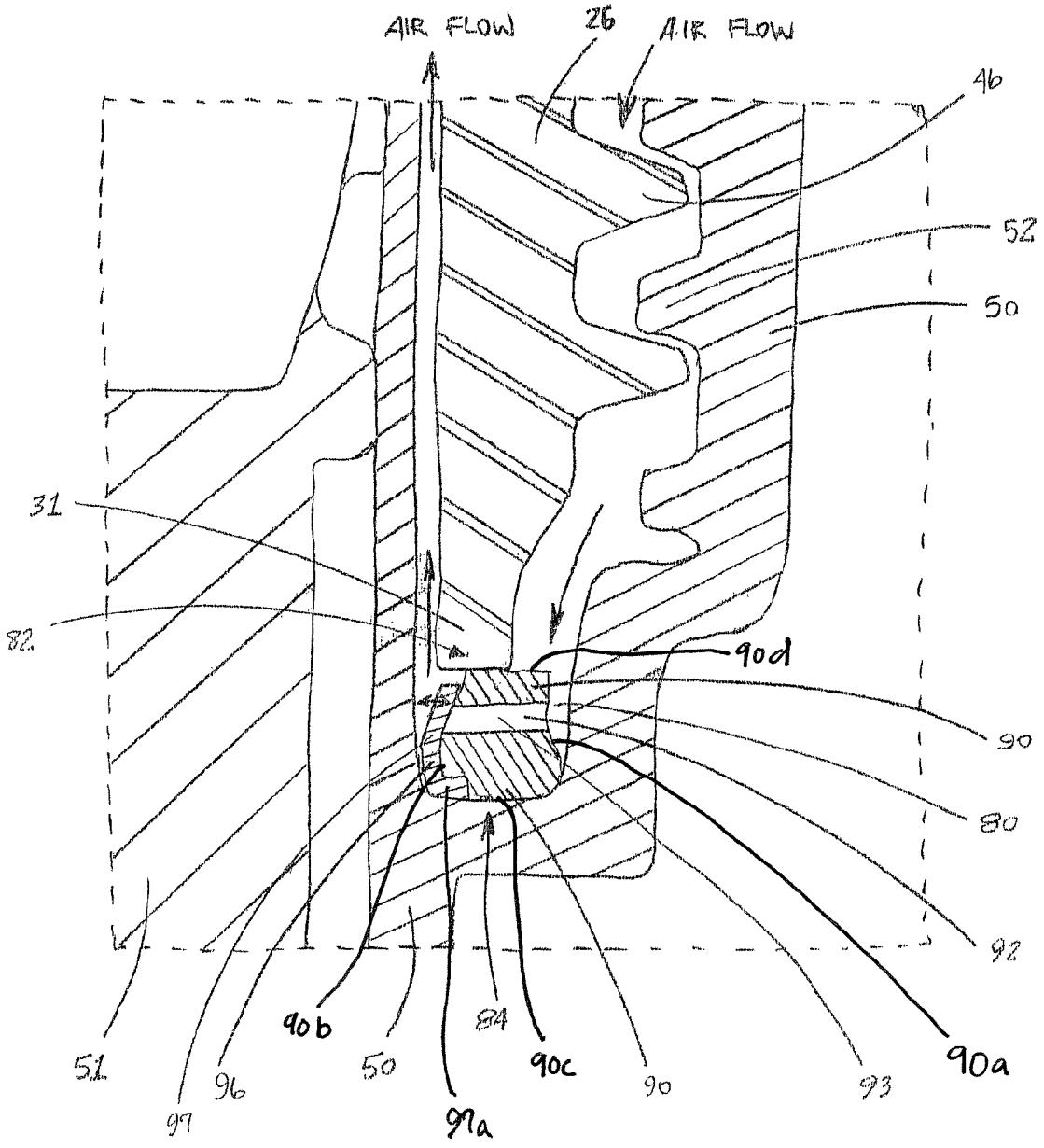
FIG. 4 is a close-up, cross sectional view of the reservoir cap showing the venting mechanism of the replaceable reservoir in a closed position, according to the embodiments of the subject invention.

FIG. 4 shows a close-up view of the cap 50 attached to the fluid reservoir 26. As can be seen in the cross-section, the threads 52 of the cap 50 engage matching threads 46 on the fluid reservoir 26, which holds the cap 50 and pump 51 in place during operation of the dispenser. In one particular embodiment, the cap 50 is configured so that when installed onto the fluid reservoir 26, a gap 80 is formed between the lower extent of the walls 31 of the fluid reservoir (shown generally at 82) and an opposing inner surface 84 of the cap 50. It is expressly noted that the cap 50 may be constructed having any contour or configuration of gap 80.

A gasket 90 is provided that inserts into the gap 80 formed between the lower extent 82 of the walls 31, also referred to herein as a rim 82, and the inner surface 84 of the cap 50. It will be readily seen that the gasket 90 has an annular configuration for filling the gap 80 described above. The gasket 90 may be constructed from elastomeric material and as such may flex to seal against the surfaces of the fluid reservoir 26 and the cap 50. In one embodiment, the gasket 90 may be constructed from polypropylene or silicone. However, any type of material may be used to form the gasket 90 as is consistent with its intended use as described herein. Notably, the gasket 90 may be sized so that its thickness slightly exceeds the thickness of the gap 80. In this manner, the gasket 90 is compressed when the cap 50 is secured to the fluid reservoir 26, which ensures a fluid tight seal between the gasket 90 and the walls 31 of the reservoir 26 and the inner surface 84 of the cap 50 respectively.

Figure 5:
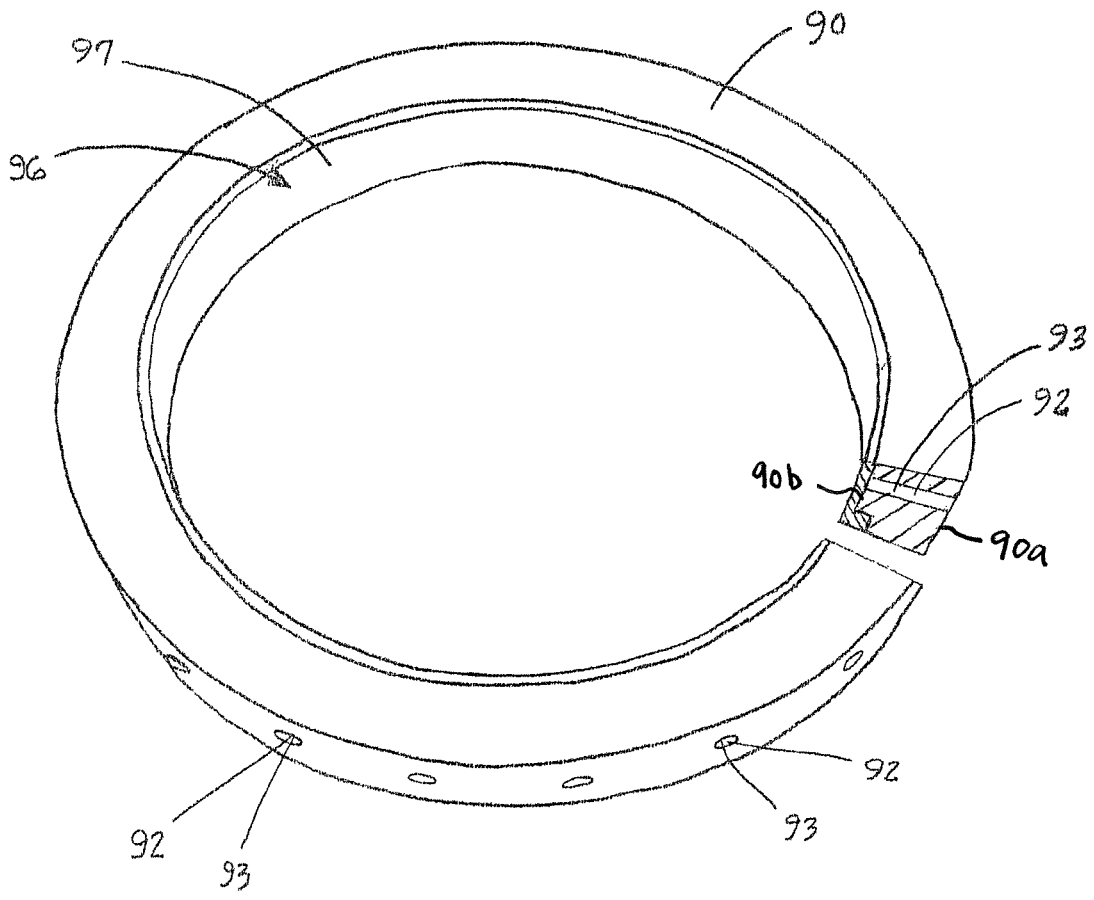
FIG. 5 is a partial cross-sectional, perspective view of the gasket of the embodiments of the subject invention.

With reference to FIGS. 4 and 5, one or more air passageways 92 are formed in the gasket 90 to prevent a vacuum from forming in the reservoir when fluid product is pumped out during a dispense event. In one exemplary embodiment, the air passageways 92 may comprise one or more holes 93 extending from an outer diameter or outer circumference (e.g., an outer circumference wall 90*a*) of the gasket 90 to its inner diameter or inner circumference (e.g., an inner circumference wall 90*b*). Stated differently, a series of holes 93 may be radially fashioned at one or more locations about the circumference of the gasket 90. It will be appreciated that the passageways 92 allows air to flow through the sealed gasket 90 and into the reservoir area 32. It follows that the overlap of opposing threads 46, 52 is sufficiently loose to allow the flow of air from the atmosphere to the gasket 90. It is contemplated in one alternate embodiment that slots, not shown, may be formed in either or both of the threads 46, 52, which breaks the continuity of the threads 46, 52 thereby providing a more direct route for air to flow through the cap 50.

The quantity and/or diameter of the holes 93 fashioned in the gasket 90 may vary as long as the combined flow-through area of the holes 93 is sufficient to allow air to quickly fill the reservoir area as fluid product is being dispensed. By "quickly filling the reservoir area" it is meant the combined area of the holes 93 is sufficiently large to allow air from the atmosphere to completely displace whatever quantity of fluid product has been meted out in a single dispense event before a subsequent dispense event occurs. In this way, negative vacuum pressure is prevented from accumulating inside the reservoir area 32 even in the event of rapid actuation of the dispensing system 10.

Still referencing FIG. 4, a one-way valve 96 may be connected to each of the air passageways 92. The one-way valve 96 functions to allow air to flow in only one direction, i.e. from the atmosphere into the reservoir area 32, as fluid product is dispensed from the dispensing system 10. Persons of skill in the art will understand that the one-way valve 96 is automatically actuated by the negative vacuum pressure generated when fluid has been pumped out of the reservoir 26. Accordingly, the one-way valve 96 is only open (as shown in FIG. 4*c*) for the duration of time that it takes to relieve the negative pressure inside the reservoir area 32 and will immediately close thereafter thus preventing fluid product from leaking back out through the holes 93 in the gasket 90.

Figure 4A:
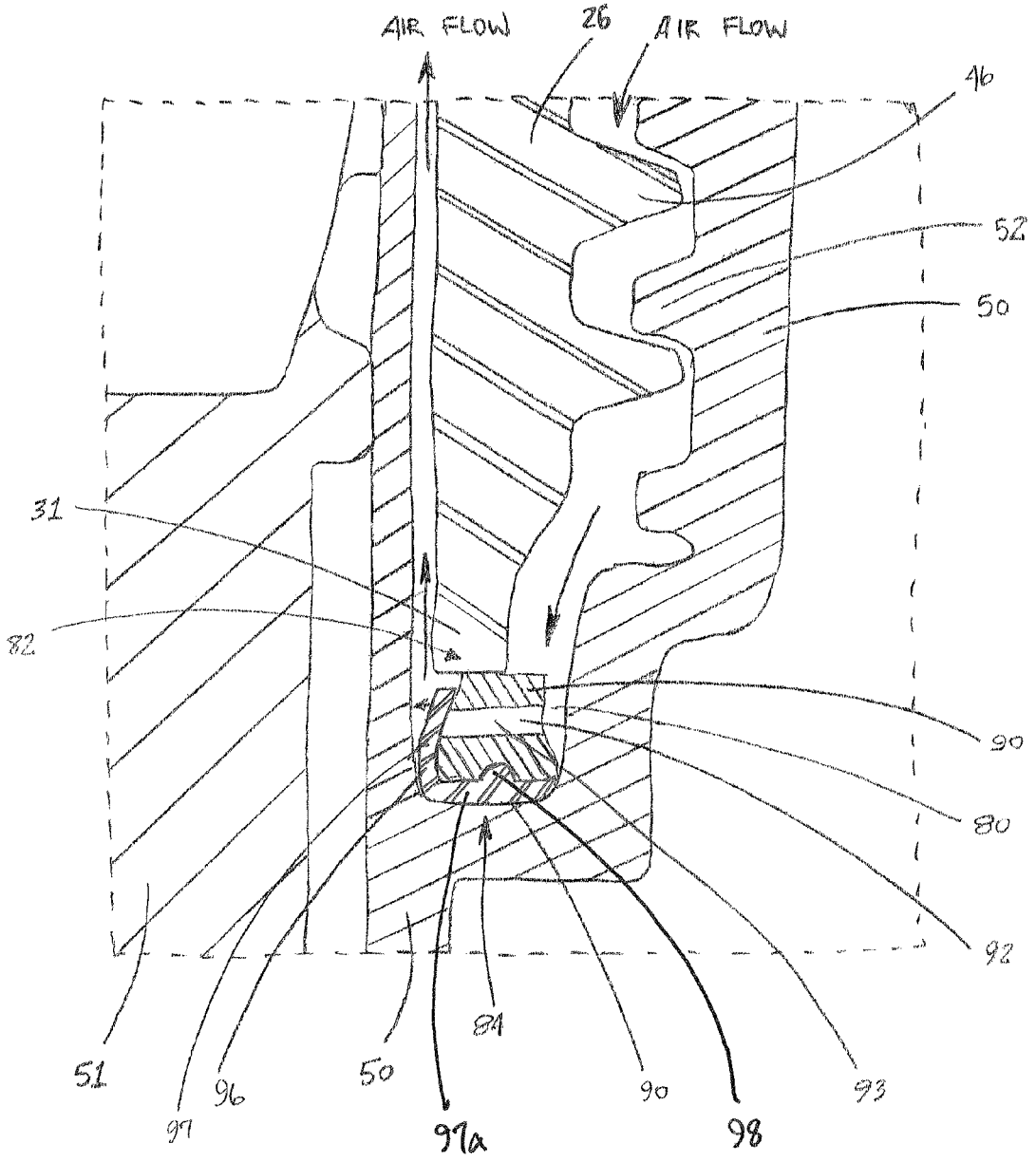
FIG. 4*a* is a close-up, cross sectional view of an alternate embodiment of the reservoir cap showing the venting mechanism of the replaceable reservoir in a closed position, according to the embodiments of the subject invention.
Figure 4B:
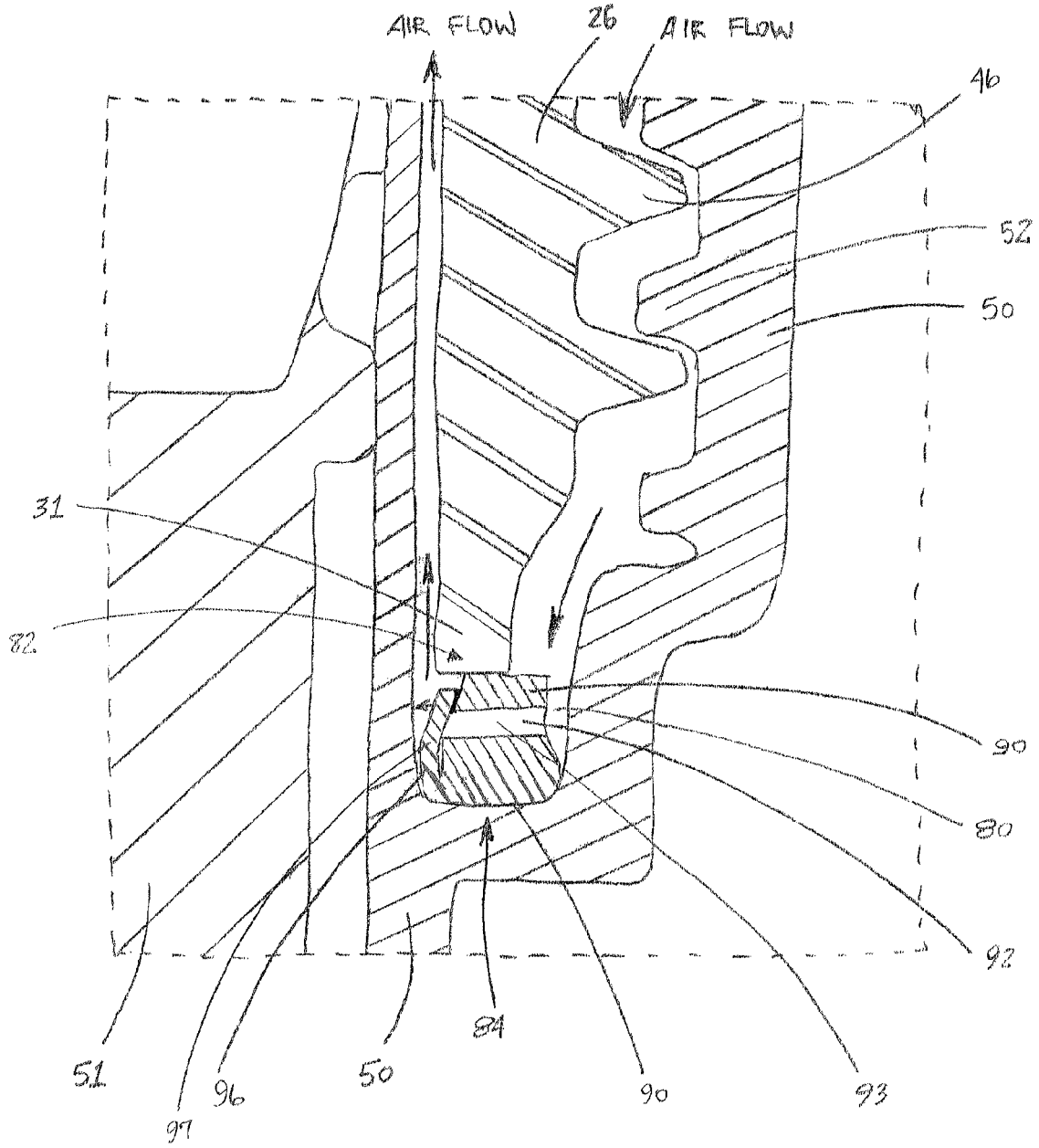
FIG. 4*b* is a close-up, cross sectional view of another alternate embodiment of the reservoir cap showing the venting mechanism of the replaceable reservoir in a closed position, according to the embodiments of the subject invention.
Figure 4C:
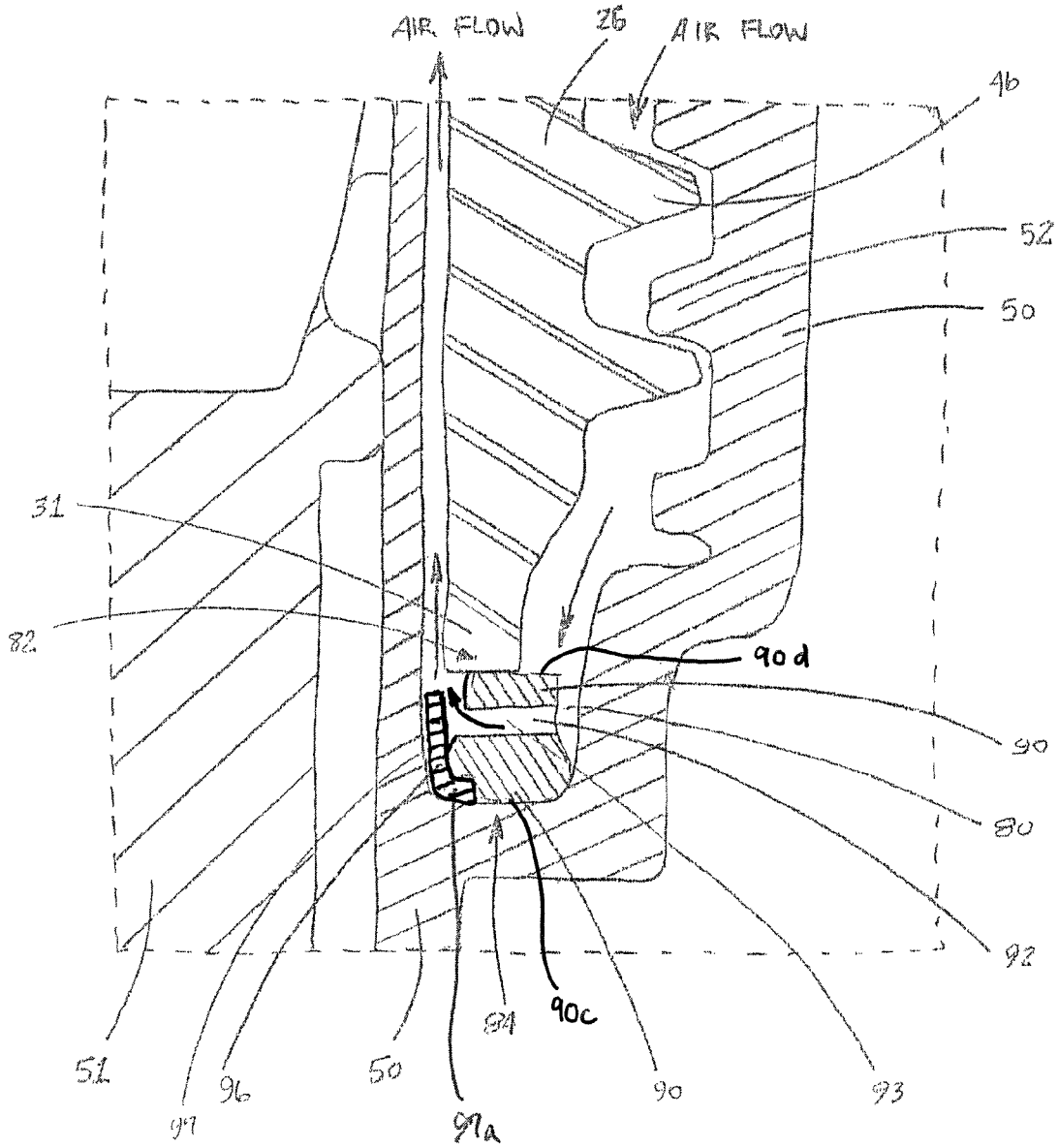
FIG. 4*c* is a close-up, cross sectional view of the reservoir cap showing the venting mechanism of the replaceable reservoir shown in FIG. 4 in an open position, according to the embodiments of the subject invention.

Referencing FIGS. 4, 4*c* and 5, in one particular embodiment, the one-way valve 96 may be comprised of a flap of material 97 extended from the gasket 90 to cover the opening of hole 93. The flap 97 may be pre-formed and possess memory such that when the flap 97 is drawn or deflected away from hole 93 (e.g., by the negative vacuum pressure, as shown in FIG. 4*c*), it returns to its original position to cover hole 93 once the pressure in the reservoir area has been relieved. In this manner, the flap 97 is biased, or biased in a first position, to cover hole 93. The flap 97 may be constructed from semi-rigid material, such as Silicone, but is flexible enough to deflect when vacuum pressure has been generated within the reservoir area 32. Accordingly, the flap 97 may be constructed having any thickness suitable for allowing it flex back and forth and thereby function as a one-way valve. It will be appreciated that the flap 97 may be shaped as a continuously-formed, annular ring similar to the configuration of the gasket 90, although other configurations may be employed. It is expressly noted that other embodiments of one-way valves 96 are contemplated. Examples may include but are not limited to ball check valves. All such variations of one way valves are to be construed as falling within the scope of coverage of the embodiments of the subject invention.

With reference now to FIGS. 4, 4*a* and 4*b*, the gasket 90 and flap 97 may be constructed from separable components or as a single piece of material (i.e. monolithically formed). FIG. 4 shows one embodiment where the gasket 90 and the flap 97 are constructed from individual components. The gasket 90 and the flap 97 may be affixed together by adhesive or other fastening means. Alternatively, the individual components of the gasket 90 and the flap 97 may be placed adjacent one another during an assembly process of the dispensing system 10 without fastening means applied therebetween. In the embodiment shown, a base portion 97*a* of the flap 97 extends generally orthogonally from the flap 97 that covers the hole 93. Notably, the flap 97 and the base portion 97*a* may extend from each other at angles other than 90 degrees as chosen with sound judgment. The base portion

97*a* may extend partially across a lower extent of the gasket 90, as shown in FIG. 4, or substantially all of the way across the lower extent of the gasket 90, as shown in FIG. 4*a*. A protrusion 98 may extend from either the gasket 90 or the base portion 97*a* to hold the components in place during use. It follows that a matching recess may be formed in the other corresponding component. In this manner, gasket 90 comprises a first gasket member and the base portion 97*a* and/or the flap 97 comprise a second gasket member. While the embodiments shown depict the flap 97 and base portion 97*a* extending from a lower extent (i.e., a first side 90*c*) of the gasket 90, which contacts the surface of the cap 50 or container lid 50, the flap 97 and/or base portion 97*a* may alternatively extend from an upper extent (i.e., a second side 90*d*) of the gasket 90 for contact with the rim 82.

With reference to FIG. 4*b*, as mentioned above, the gasket 90 and flap 97 may be constructed as a monolithic component. In this embodiment, the flap 97 and gasket 90 is molded as a single component or otherwise fashioned from the same material. It will be readily understood that the flap 97 may extend from the upper extent or lower extent of the gasket 90 without departing from the intended scope of coverage of the embodiments of the subject invention.

The dispensing system 10 may further include a control system (mentioned above) comprising one or more electronic circuits, not shown, for controlling the sequence of operation of the dispensing system 10. The electronic circuitry may reside on a printed circuit board and received in a suitable enclosure, not shown. Energy may be supply from the batteries to power the control system. In one embodiment, the digital electronic circuitry is included in the control system and functions to receive input signals from the electronic validation key 60 and onboard sensors 42. The digital electronic circuitry may also function to output signals used to control operation of the dispensing system 10, like for example operation of the motor, not shown.

During maintenance of the dispenser 10, service personnel may detach the existing fluid reservoir 26 from the base 14 and replace it with a new sanitary fluid reservoir. Once installed, the control system will check the signal received by the interrogator to ensure that the correct refill unit has been installed. Upon verification, the control system will enable the motor to actuate the pump 51 when activated by the user.

Having illustrated and described the principles of the dispensing system in one or more embodiments, it should be readily apparent to those skilled in the art that the invention can be modified in arrangement and detail without departing from such principles.

It is claimed:

1. A refill unit for an associated dispenser dispensing an associated liquid product, comprising:

a container having one or more walls defining a volumetric region for storing the associated liquid product, wherein the container includes an opening defining a rim, and wherein the container includes a first fastening member;

a container lid covering the opening wherein a surface of the container lid is juxtaposed to the rim, and wherein the container lid includes a second fastening member operatively attached to the first fastening member for affixing the container lid to the container;

a pump operatively connected to dispense the associated liquid product from the container;

a gasket disposed between the rim and the surface of the container lid to seal the rim and the container lid in a liquid tight manner, wherein the gasket is generally annular thereby defining an inner circumference wall and an outer circumference wall, and wherein the gasket includes a hole extending from the outer circumference wall to the inner circumference wall; and, a flap extending from the gasket to selectively cover the hole in the gasket, wherein the associated liquid product is prevented from passing through the hole and out of the container, and wherein ambient air is allowed to pass through the hole and into the container when the pump is operated to dispense the associated liquid product.

2. The refill unit as defined in claim 1, wherein the flap is integrally formed with the gasket.

3. The refill unit as defined in claim 1, wherein the flap is generally pliable and is constructed from material having memory, and wherein the flap is biased in a first position to cover the hole, and wherein the flap is deflectable from the first position to a second position to expose the hole when the pump is operated to dispense the associated liquid product.

4. The refill unit as defined in claim 1, wherein the gasket includes a plurality of holes spaced around the inner circumference of the gasket; and, wherein the flap has an annular configuration adapted to cover the plurality of holes in the gasket.

5. A refill unit for an associated dispenser dispensing an associated liquid product, comprising:

a container having one or more walls defining a volumetric region for storing the associated liquid product, wherein the container includes an opening defining a rim;

a container lid covering the opening wherein a surface of the container lid is juxtaposed to the rim, wherein the container lid includes an aperture through which the associated liquid product is dispensed from the container;

a first gasket member in sealing engagement with the rim of the container, wherein the first gasket member includes a hole extending therethrough thereby creating a passage for communicating ambient air from outside the container into the volumetric region, and wherein the hole of the first gasket member is disposed in a gap that is formed between a lower extent of the rim an opposing inner surface of the container lid; and, a second gasket member juxtaposed to the first gasket member in sealing engagement therewith, wherein the second gasket member is also in sealing engagement with the surface of the container lid, wherein the second gasket member is constructed from elastically deformable material configured to cover the hole in first gasket member to prevent the associated liquid product from passing through the hole in the first gasket member, and wherein when the associate liquid product is dispensed from the container the second gasket member is deflected from covering the hole thereby allowing ambient air to flow into the volumetric region.

6. The refill unit as defined in claim 5, wherein the first gasket member is fixedly attached to the second gasket member.

7. The refill unit as defined in claim 5, wherein the second gasket member is comprised of:

a base portion that seals against the surface of the container lid; and, a flap integrally form with the base portion, wherein the flap extends generally orthogonally from the base to cover the hole in the first gasket member.

8. The refill unit as defined in claim 5, wherein the first gasket member has an annular configuration defining an inner circumference and an outer circumference, wherein the hole extends from the outer circumference to the inner circumference, and wherein the second gasket member has an annular configuration.

9. The refill unit as defined in claim 8, wherein the first gasket member includes a plurality of holes spaced around the inner circumference of the first gasket member.

10. The refill unit as defined in claim 8, wherein the first gasket member includes a plurality of holes spaced equidistantly around the inner circumference of the first gasket member.

11. The refill unit as defined in claim 5, further comprising:

a selectively actuatable pump operatively fluidly connected to the aperture in the container lid to dispense the associated liquid product from the refill unit.

12. A gasket for an associated container storing an associated product wherein the associated container includes an opening defining a rim, and an associated container lid covering the opening wherein a surface of the associated container lid is juxtaposed to the rim, the gasket comprising:

a generally planar gasket having first and second sides separated by a body portion, wherein the gasket is generally annular thereby defining an inner circumference wall and an outer circumference wall, and wherein the body portion includes a plurality of spaced apart holes extending from the outer circumference wall to the inner circumference wall; and, a flap extending from one of the first and second sides of the generally planar gasket to the inner circumference of the gasket, wherein the flap is constructed from elastic deformable material having memory whereby the flap is biased in a first position to cover the plurality of spaced apart holes on the inner circumference wall of the gasket thereby preventing the passage of the associated product through the plurality of spaced apart holes from the inner circumference wall to the outer circumference wall, and wherein the flap is deflectable to a second position exposing the holes on the inner circumference wall of the gasket.

13. The gasket as defined in claim 12, wherein the plurality of holes are substantially equidistantly positioned around the gasket.

14. The gasket as defined in claim 12, wherein the gasket and the flap are integrally fashioned as a singular unit.

15. The gasket as defined in claim 12, wherein the gasket and the flap are separable components.

* * * * *